US010020616B2

(12) United States Patent
Hartman et al.

(10) Patent No.: US 10,020,616 B2
(45) Date of Patent: Jul. 10, 2018

(54) LOCKING ELECTRICAL OUTLET

(71) Applicant: Panduit Corp., Tinley Park, IL (US)

(72) Inventors: Scott R. Hartman, Oak Forest, IL (US); Shaun P. Brouwer, St. John, IN (US); Surendra Chitti Babu, New Lenox, IL (US); Masud Bolouri-Saransar, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/685,578

(22) Filed: Aug. 24, 2017

(65) Prior Publication Data

US 2018/0062317 A1 Mar. 1, 2018

Related U.S. Application Data

(60) Provisional application No. 62/381,135, filed on Aug. 30, 2016.

(51) Int. Cl.

| | |
|---|---|
| ***H01R 13/627*** | (2006.01) |
| ***H01R 13/639*** | (2006.01) |
| ***H01R 24/40*** | (2011.01) |
| ***H01R 43/26*** | (2006.01) |
| ***E05B 43/00*** | (2006.01) |
| ***H01R 13/20*** | (2006.01) |

(Continued)

(52) U.S. Cl.

CPC ..... *H01R 13/639* (2013.01); *H01R 13/6276* (2013.01); *H01R 13/6397* (2013.01); *H01R 24/20* (2013.01); *H01R 43/26* (2013.01); *E05B 43/00* (2013.01); *H01R 13/20* (2013.01); *H01R 2103/00* (2013.01)

(58) Field of Classification Search

CPC .. H01R 13/62; H01R 13/6271; H01R 13/629; H01R 13/639; H01R 13/6395; H01R 13/6397; H01R 43/26; E05B 43/00

USPC ..... 439/346

See application file for complete search history.

(56) References Cited

U.S. PATENT DOCUMENTS 3,890,028 A 6/1975 Blanchenot
4,627,681 A * 12/1986 Hong ..... H01R 13/193 439/263

(Continued)

FOREIGN PATENT DOCUMENTS

GB 2463468 A 3/2010

*Primary Examiner* — Edwin A. Leon
*Assistant Examiner* — Oscar Jimenez
(74) *Attorney, Agent, or Firm* — Christopher S. Clancy; James H. Williams; Christopher K. Marlow

(57) ABSTRACT

A locking electrical outlet has a housing with a channel and an outlet latch within, a slider configured to move axially within the channel, a memory block, a locking plate with an opening, and a spring configured to bias the locking plate towards a first angle. The slider is configured move axially rearward relative to the housing by the insertion of the plug. The rearward movement of the slider reduces the angle of the locking plate such that a blade of the plug can move through the opening of the locking plate. The memory block is partially compressed by the slider such that it the slider engages the outlet latch of the housing, temporarily holding the locking plate at the reduced angle until the expansion of the memory block disengages the slider from the outlet latch and allows the spring to return locking plate towards the first angle.

9 Claims, 17 Drawing Sheets

(51) Int. Cl.
*H01R 24/20* (2011.01)
*H01R 103/00* (2006.01)

(56) References Cited

U.S. PATENT DOCUMENTS 4,971,571 A 11/1990 Puerner
6,062,886 A * 5/2000 Chen ..... H01R 13/521 200/51.09
6,193,539 B1 * 2/2001 Chang ..... H01R 13/6278 439/346
6,231,359 B1 * 5/2001 Inaba ..... H01R 13/629 439/157
6,790,070 B1 * 9/2004 England, II ..... H01R 13/6397 439/305
7,641,489 B1 * 1/2010 Hsu ..... H01R 13/4538 200/51.09
8,152,554 B2 4/2012 Chapel et al.
8,435,055 B1 * 5/2013 Bhosale ..... H01R 13/4534 439/145
8,439,697 B2 5/2013 Vass
8,668,512 B2 3/2014 Chang
8,714,995 B2 * 5/2014 Chang ..... H01R 13/639 439/345
8,951,059 B2 * 2/2015 Chang ..... H01R 13/6392 439/346
9,065,207 B2 * 6/2015 Chapel ..... H01R 43/26
2004/0147148 A1 * 7/2004 Ng ..... H01R 13/4534 439/137
2005/0101169 A1 * 5/2005 Ratcliffe ..... H01R 13/639 439/106
2014/0213093 A1 * 7/2014 Tal ..... H01R 13/20 439/352
2014/0227897 A1 8/2014 Chang
2017/0133791 A1 * 5/2017 Vass ..... H01R 13/6395
2017/0279224 A1 * 9/2017 Chapel ..... H01R 13/639

* cited by examiner

LOCKING ELECTRICAL OUTLET

CROSS-REFERENCE TO RELATED APPLICATIONS

This application claims priority to U.S. Provisional Application No. 62/381,135, filed Aug. 30, 2016, the subject matter of which is hereby incorporated by reference in its entirety.

FIELD OF THE INVENTION

The present invention relates generally to electrical outlets and specifically to a locking electrical outlet with a time delay.

BACKGROUND OF THE INVENTION

When electrical plugs are installed into electrical outlets, a method for preventing inadvertent disconnection is often desired. Inadvertent disconnection can occur for a variety of reasons such as vibration, incidental contact, etc. This specification describes a concept for a locking electrical outlet utilizing a time-delayed locking mechanism, as well as a fail-safe mechanism to prevent outlet damage due to improper unlocking.

SUMMARY

A locking electrical outlet has a housing with a channel and an outlet latch within, a slider configured to move axially within the channel, a memory block, a locking plate with an opening, and a spring configured to bias the locking plate towards a first angle. The slider is configured move axially rearward relative to the housing by the insertion of the plug. The rearward movement of the slider reduces the angle of the locking plate such that a blade of the plug can move through the opening of the locking plate. The memory block is partially compressed by the slider such that it the slider engages the outlet latch of the housing, temporarily holding the locking plate at the reduced angle until the expansion of the memory block disengages the slider from the outlet latch and allows the spring to return locking plate towards the first angle.

DETAILED DESCRIPTION OF THE PREFERRED EMBODIMENTS

Figure 7:
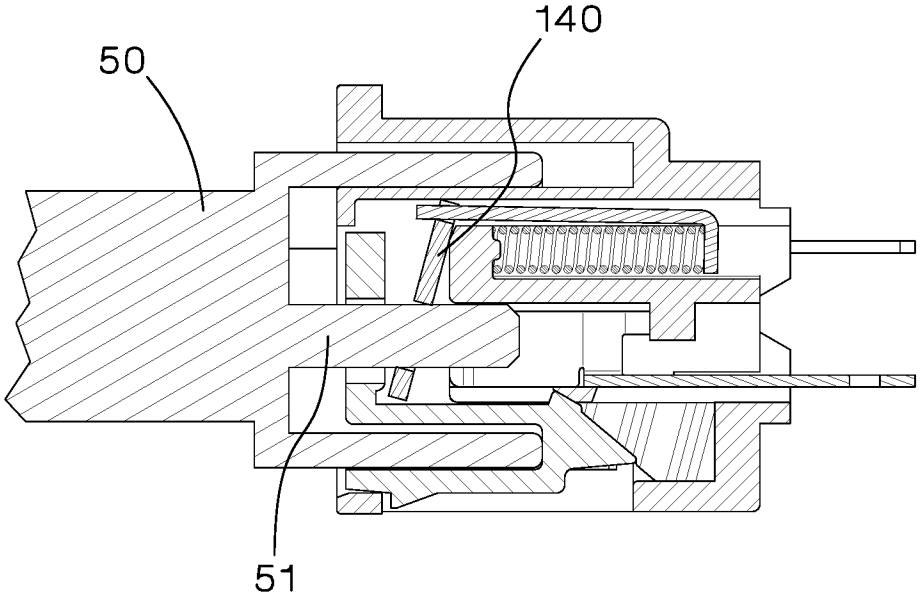
FIG. 7 is a cross-sectional view of the locking electrical outlet of FIG. 1 with the plug inserted and the locking plate engaging the ground prong of the plug.
Figure 8:
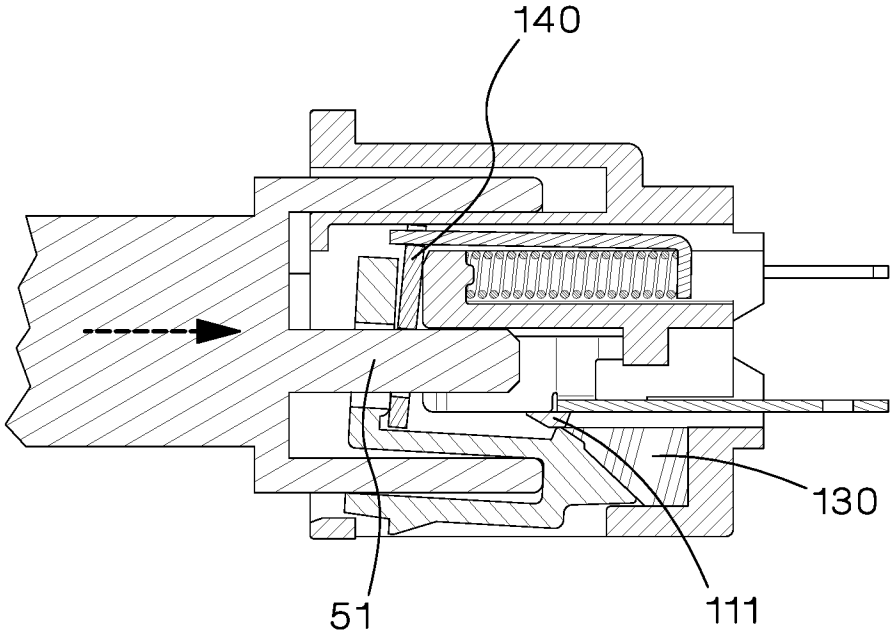
FIG. 8 is a cross-sectional view of the locking electrical outlet of FIG. 1 showing a point in the process of removing the plug at the point where the plug is being pushed in in order to disengage the locking plate.
Figure 9:
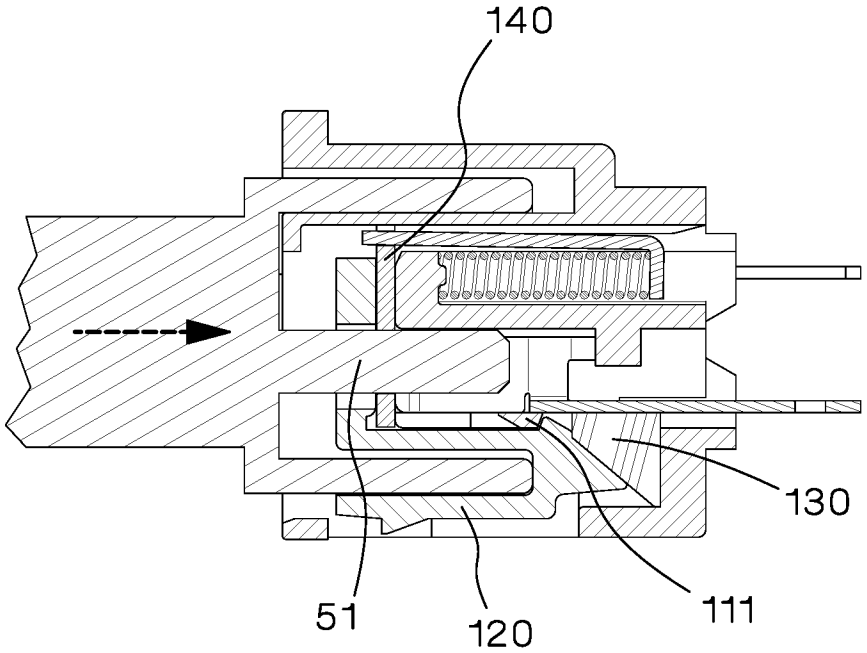
FIG. 9 is a cross-sectional view of the locking electrical outlet of FIG. 1 showing a point in the process of removing the plug where the plug is fully inserted and the locking plate is disengaged.

A spring loaded metal locking plate is contained within the outlet. The metal locking plate has a rectangular opening in it (FIG. 3) that is sized such that when the locking plate is positioned at an angle (default/locked position) the edges of the opening will engage and grip the ground blade of the plug to retain the plug in the outlet (FIG. 7). When the locking plate is in a vertical position (unlocked) the ground pin can move freely through the rectangular opening of the locking plate (FIG. 9).

Figure 1:
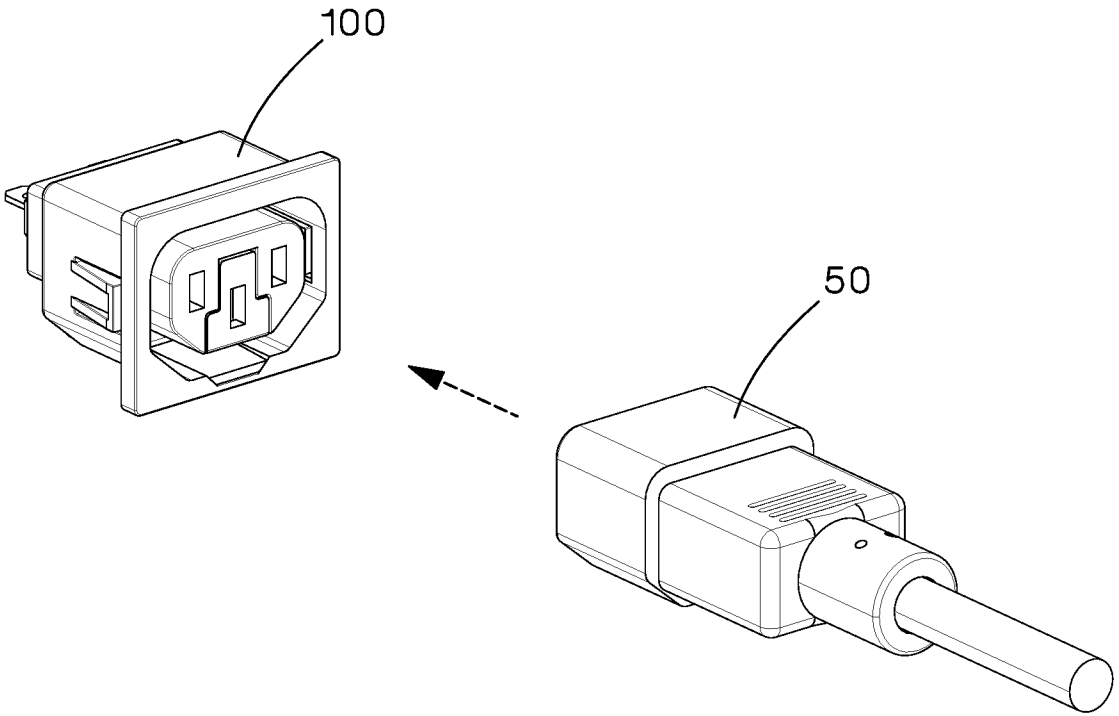
FIG. 1 shows an isometric view of a first embodiment of a locking electrical outlet.

FIG. 1 shows one embodiment of a locking electrical outlet 100 with a complimentary plug 50.

Figure 2:
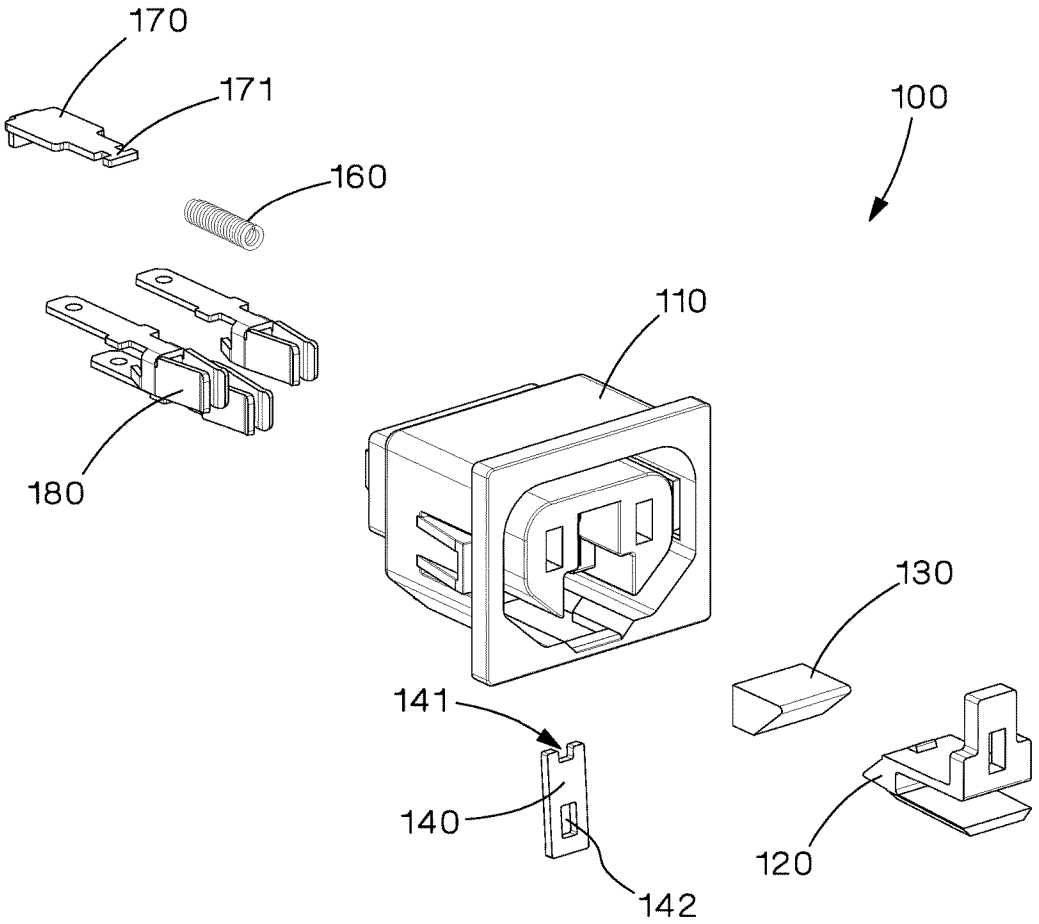
FIG. 2 shows an exploded isometric view of the locking electrical outlet of FIG. 1.
Figure 3:
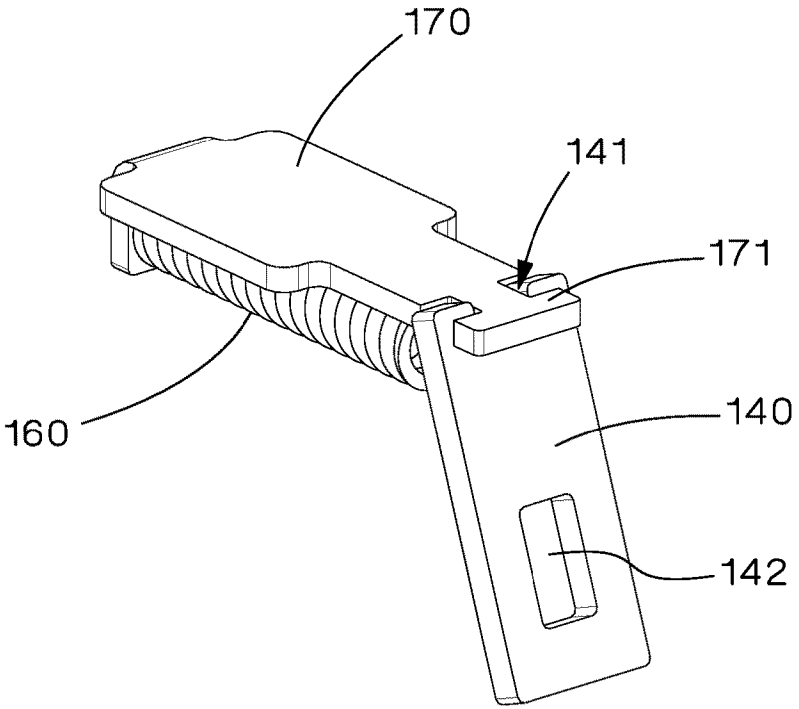
FIG. 3 shows an isometric view of the interaction of the spring, locking plate, and connecting arm of the locking electrical outlet of FIG. 1.

As shown in FIG. 2, the locking electrical outlet 100 has a housing 110, a slider 120, a memory block 130, a locking plate 140 with an opening 142, spring 160, a connecting arm 170, and electrical contacts 180. As shown in FIG. 3, the connecting arm 170 engages the locking plate 140 via a tab 171 on the connecting arm engaging a notch 141 on the locking plate.

Figure 4B:
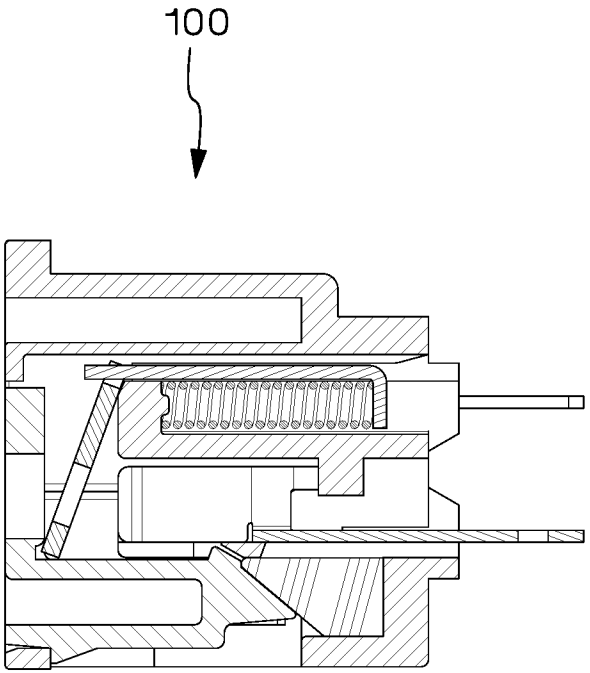
FIG. 4B shows a cross-sectional view of the locking electrical outlet of FIG. 1 taken along line 4B-4B of FIG. 4A.
Figure 4A:
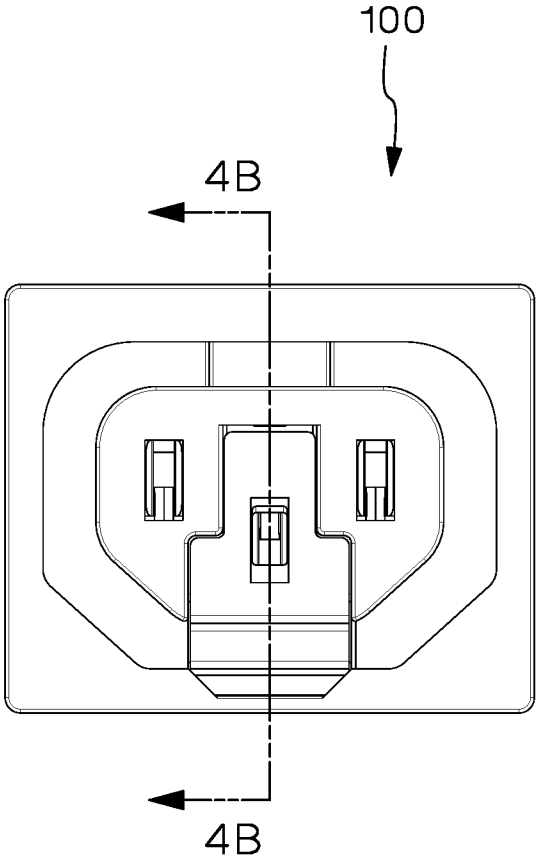
FIG. 4A shows a front view of the locking electrical outlet of FIG. 1.
Figure 5:
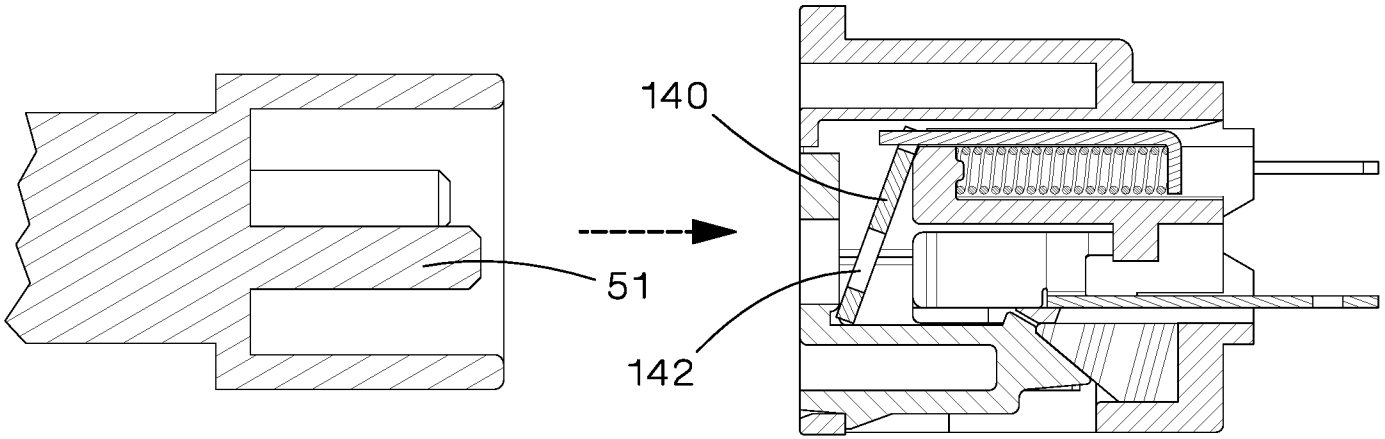
FIG. 5 is a cross-sectional view of the locking electrical outlet of FIG. 1 showing a plug prior to insertion into the locking electrical outlet.
Figure 6:
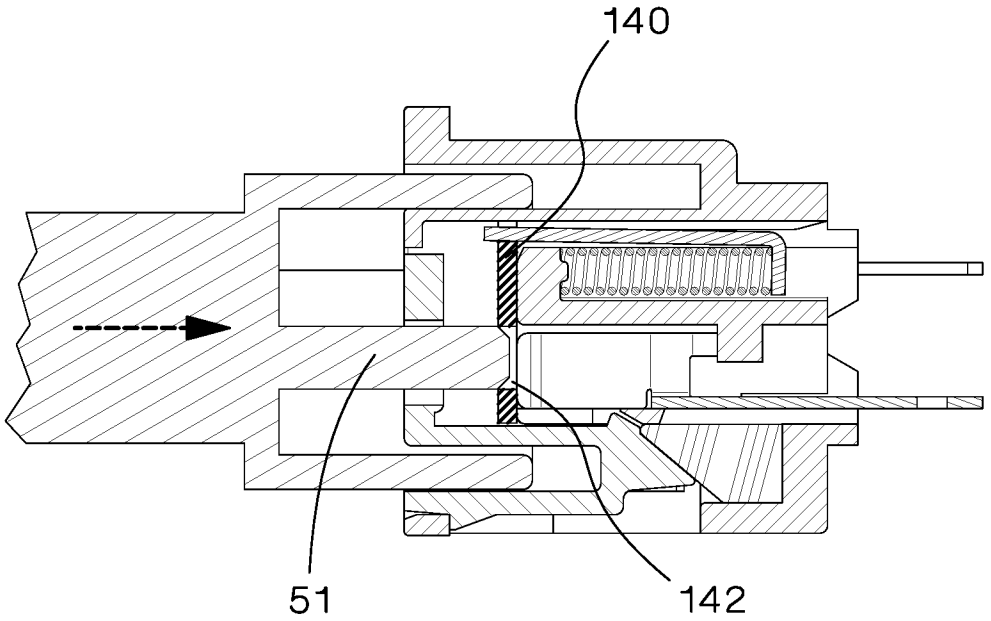
FIG. 6 is a cross-sectional view of the locking electrical outlet of FIG. 1 showing a plug being inserted into the locking electrical outlet.

FIG. 4A is a front view of the locking electrical outlet 100. FIG. 4B is a cross-sectional view of the locking electrical outlet 100 taken along line 4B-4B of FIG. 4A. FIGS. 5-13 are cross-sectional views taken along similar the same line as the view of FIG. 4B that help to highlight the operation of the locking electrical outlet 100. FIG. 5 shows a cross-sectional view of the locking electrical outlet 100 prior to the insertion of the plug 50. As the plug 50 is inserted into the locking electrical outlet 100, the ground blade 51 of the plug 50 pushes the locking plate 140 into a vertical position (see FIG. 6). Once the locking plate 140 is vertical, the ground blade 51 of the plug 50 is able to pass freely through a rectangular opening 142 in the locking plate 140. Once the plug 50 is inserted, the spring 160 returns the locking plate 140 into an engaging position by placing it at an angle such that the edges of the opening will engage the ground blade 51 of the plug 50 (see FIG. 7).

Figure 10:
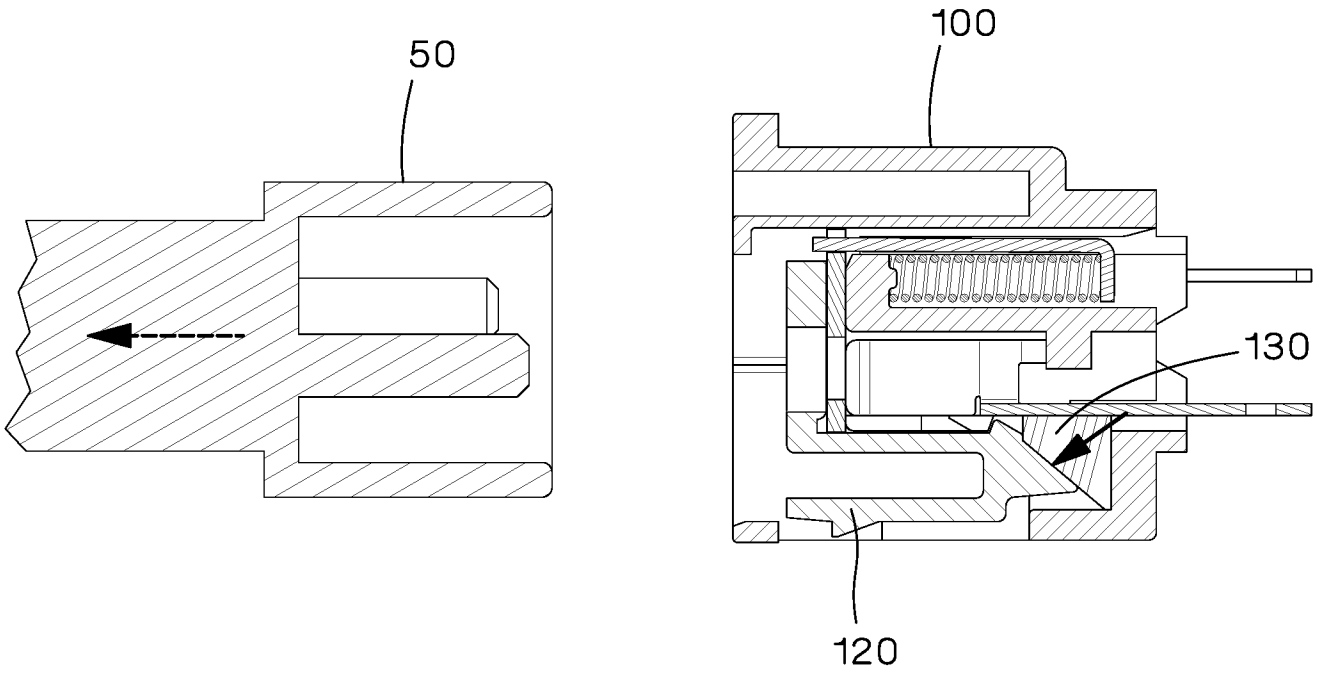
FIG. 10 is a cross-sectional view of the locking electrical outlet of FIG. 1 showing a point in the process of removing the plug where the plug is removed but the memory block is holding the locking plate in the vertical or disengaged position via the slider.
Figure 11:
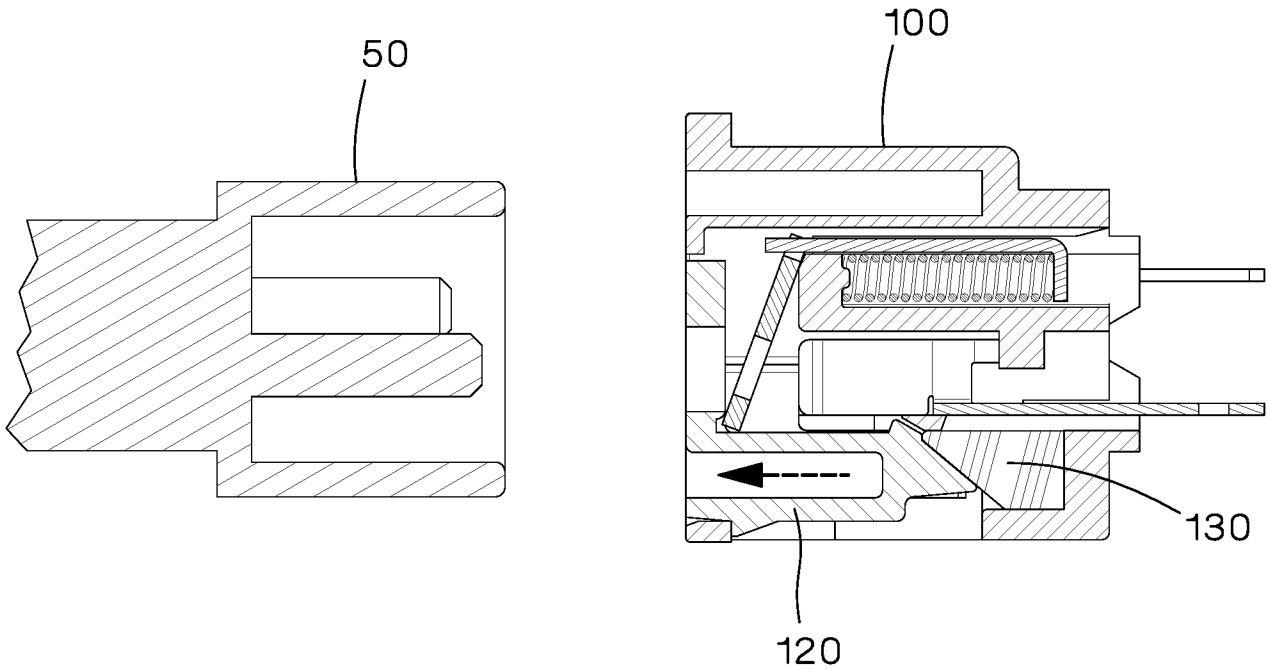
FIG. 11 is a cross-sectional view of the locking electrical outlet of FIG. 1 showing a point in the process of removing the plug where the plug is removed and the memory block has released the slider.

Unlocking the plug 50 is achieved by first pushing the plug 50 all the way into the locking electrical outlet 100 outlet before pulling the plug out 50. Pushing the plug 50 into the locking electrical outlet 100 moves the slider 120 thereby rotating the locking plate 140 into a vertical position for unlocking. As the slider 120 moves into the outlet 100 it tilts down under an outlet latch 111 (FIG. 8) and starts to compress the memory block 130. In one embodiment, the memory block 130 can be a slow-rebounding material such as polyurethane foam or visco-elastic polyurethane. Once the slider 120 is fully inserted, it temporarily latches on the locking electrical outlet 100 until it is pushed out by the expansion of the memory block 130. While the slider 120 is in the latched position, its position holds the locking plate 140 vertical (FIG. 9), providing a time-delay during which the plug 50 can be removed from the locking electrical outlet 100 (FIG. 10). The memory block 130 slowly expands (FIG. 10) to eventually unlatch the slider 120 so that it resets to its default/locked position (FIG. 11), where it is ready to accept a plug 50 again. The amount of time-delay can be tuned by using different grades/durometers/sizes of memory material as well as adjusting the latch geometry.

Figure 12:
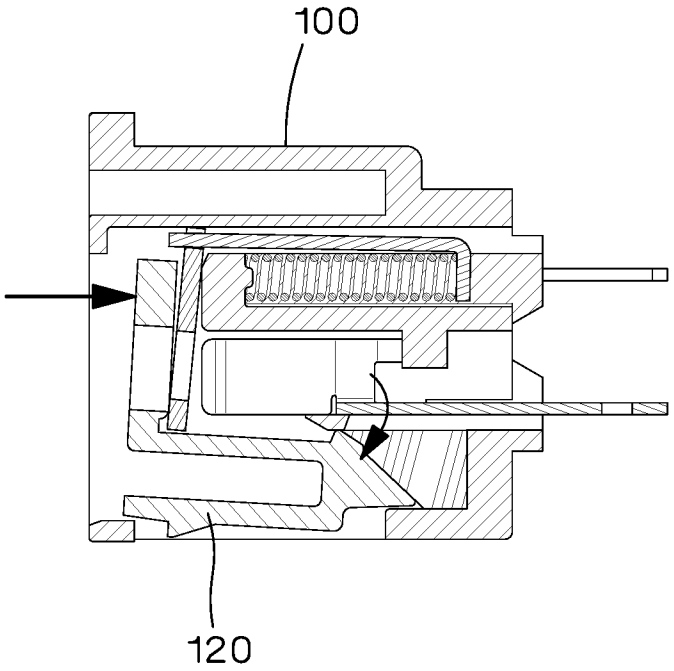
FIG. 12 is a cross-sectional view of the locking electrical of FIG. 1 showing how applying a force on bottom of the slider can release the slider in the case where the memory block does not release the slider on its own.

In the event that the memory block 130 does not reset the lock mechanism, the locking electrical outlet 100 will still work electrically as a non-locking outlet when a plug is inserted again. If necessary, the locking mechanism can be manually reset by pushing the top of the slider 120 in which will unlatch the slider 120 from its unlocked position (FIG. 12). Once the slider 120 is unlatched, the spring 150 and locking plate 140 return it to their locked/default position.

Figure 13:
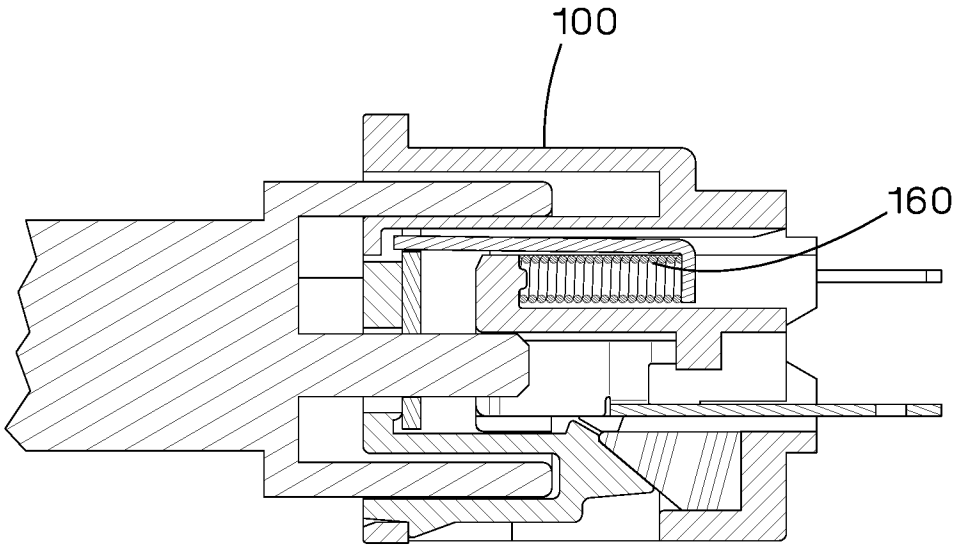
FIG. 13 is a cross-sectional view of the locking electrical outlet of FIG. 1 showing the fail-safe function which allows the spring to compress and place the locking plate in a vertical position when excessive force is applied while pulling on the plug without first pushing it in to disengage the locking plate.

The locking electrical outlet 100 requires the user to first push the plug 50 into the locking electrical outlet 100 to unlock before pulling the plug 50 out. However, if the user fails to push the plug 50 in first, the locking electrical outlet 100 can have a fail-safe mechanism to ensure that the outlet will not suffer permanent damage in the event the plug 50 is removed while locked. Pulling the plug 50 while locked rotates the locking plate 140 into a vertical position, compressing the spring 160 via the connecting arm 170 (FIG. 13). The compression spring 160 rate determines the force at which the failsafe mechanism is activated.

Figure 14:
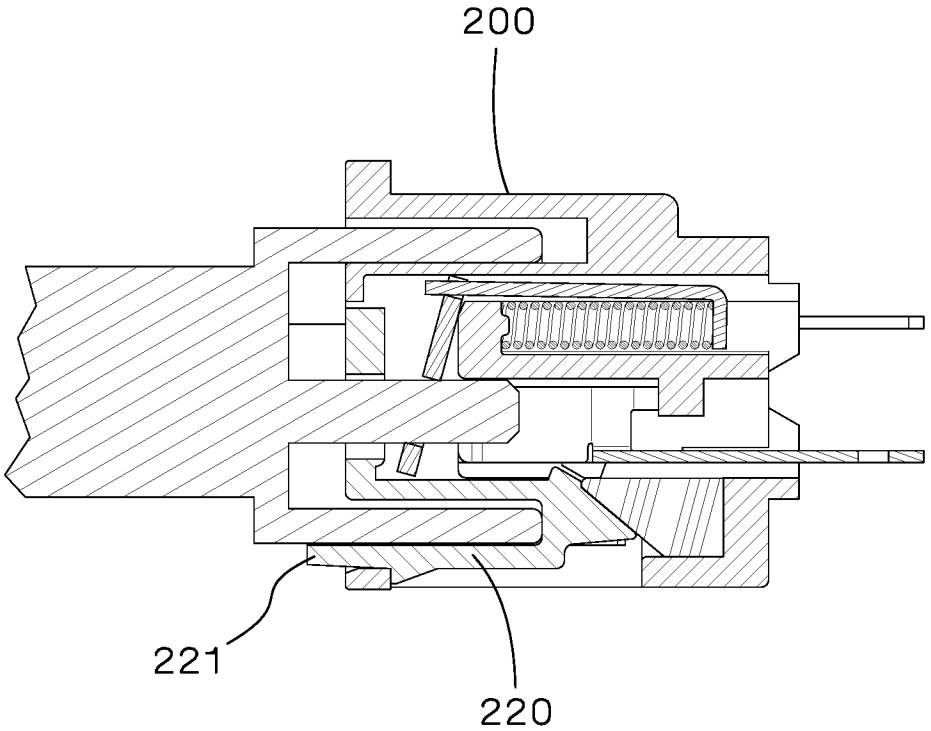
FIG. 14 is a cross-sectional view of a second embodiment of a locking electrical outlet showing a slider which has a portion protruding out the front of the outlet letting the user know the outlet is in a locking position.

While the first embodiment shows an outlet designed such that the default position is always locked, in some instances it may be desirable to have a visual indication that the outlet is either locked or unlocked. FIG. 14 below shows a second embodiment of a locking electrical outlet 200 where the bottom leg of the slider 221 projects out from the face of the locking electrical outlet 200 when the locking electrical outlet 200 is in the locked position, providing a visual indication.

Figure 15:
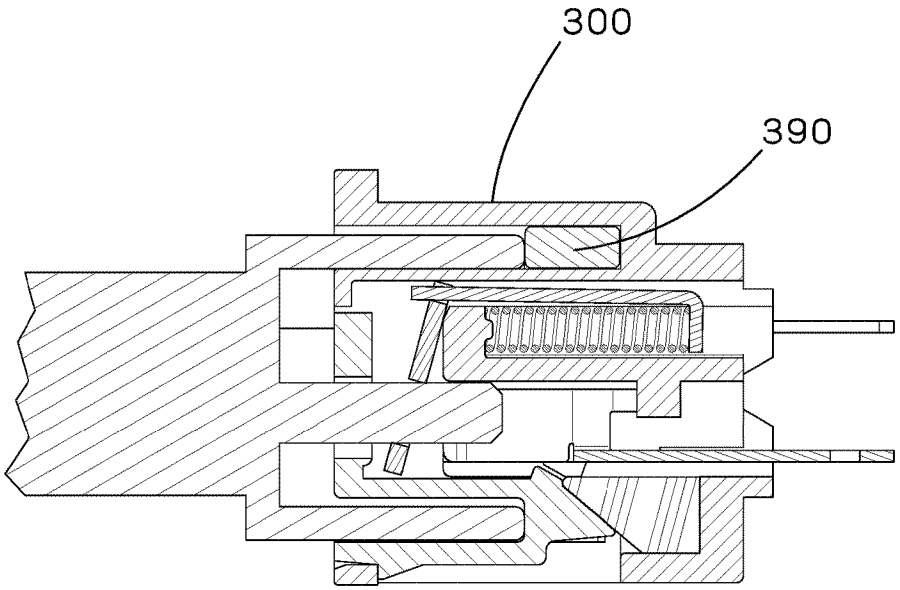
FIG. 15 is a cross-sectional view of a third embodiment of a locking electrical outlet which uses a compressible member for balancing out forces on the plug in order to aide in the relocking of outlet.

FIG. 15 shows third embodiment of a locking electrical outlet 300 which adds a compressible member 390 may be needed to balance forces on the plug 50 so that the plug 50 will properly re-lock automatically. This compressible member 390 could be a block made out of rubber, elastomer, foam, etc. or a compression spring.

Figure 16:
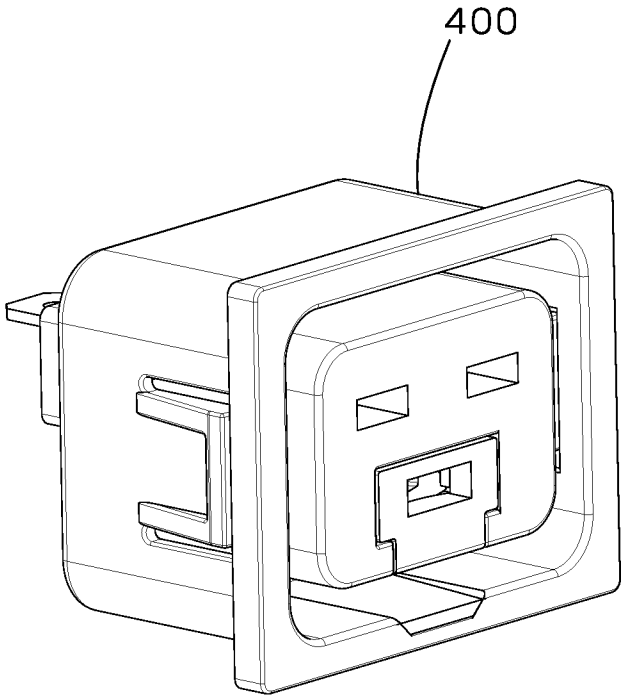
FIG. 16 is an isometric view of a fourth embodiment of a locking electrical outlet showing an IEC C19 outlet design.
Figure 17B:
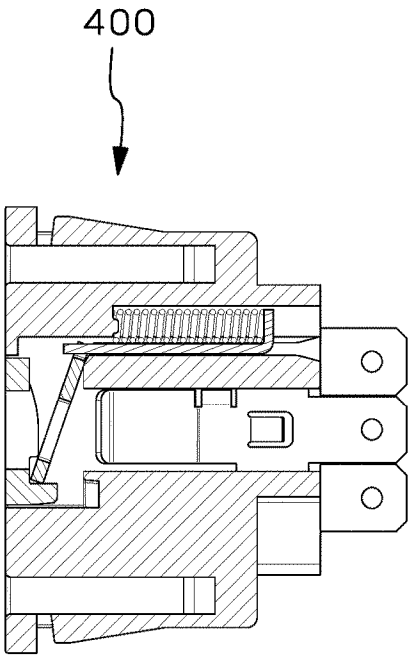
FIG. 17B is a cross-sectional view of the locking electrical outlet of FIG. 16 taken along line 17B-17B of FIG. 17A.
Figure 17A:
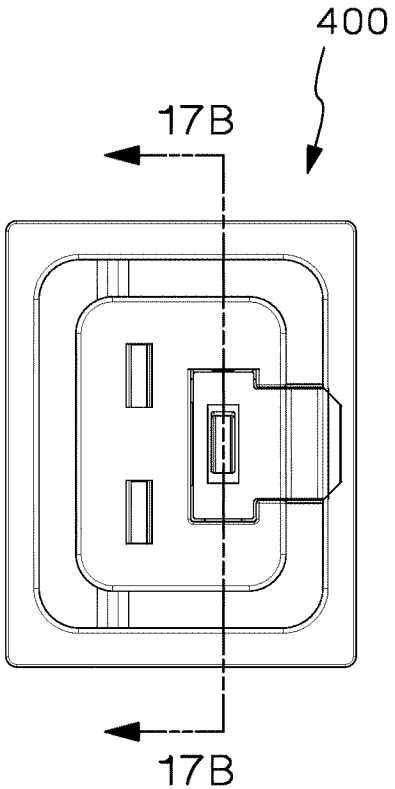
FIG. 17A is a front view of the locking electrical outlet of FIG. 16.

FIGS. 16 and 17 show a fourth embodiment 400 of a locking electrical outlet 400 depicting an IEC C19 outlet design.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A locking electrical outlet for use with a plug comprising:

a housing, the housing defining a front face and having a channel with an outlet latch;

a slider configured to move axially relative to the housing within the channel wherein axially is defined as a direction parallel to a direction of an insertion of the plug;

a memory block composed of a slow-rebounding compressible material;

a locking plate, the locking plate having an opening;

a spring configured to bias the locking plate towards a first angle relative to the front face of the housing, wherein the slider is configured to be moved axially rearward relative to the housing by the insertion of the plug and further wherein the rearward movement of the slider reduces the angle of the locking plate such that it allows a blade of the plug to move through the opening of the locking plate, the memory block configured to be at least partially compressed by the slider such that it allows the slider to engage the outlet latch of the housing and temporarily hold the locking plate at the reduced angle and further wherein an expansion of the memory block disengages the slider from the outlet latch and allows the spring to return the locking plate towards the first angle.

2. The locking electrical outlet of claim 1 wherein the spring biases the locking plate towards the first angle by exerting a force on a connecting arm that is mechanically engaged with the locking plate.

3. The locking electrical outlet of claim 2 wherein the connecting arm engages the locking plate via a tab and notch arrangement.

4. The locking electrical outlet of claim 2 wherein a tab on the connecting arm engages a notch on the locking plate.

5. The locking electrical outlet of claim 2 wherein the connecting arm, spring, and locking plate are configured such that a removal force exerted on the plug will reduce the angle of the locking plate relative to the front face of the locking electrical outlet such that the blade of the plug may move through the opening of the locking plate.

6. The locking electrical outlet of claim 1 wherein the slider has an aperture configured to accept a blade of the plug and further wherein the opening of the locking plate is aligned with the aperture of the slider.

7. The locking electrical outlet of claim 1 wherein the aperture of the slider is configured to accept a ground blade of the plug.

8. The locking electrical outlet of claim 1 wherein a leg of the slider projects forwards from the front face in order to provide a visual indication of the outlet being in a locked position.

9. The locking electrical outlet of claim 1 further comprising a second compressible member wherein the second compressible member exerts a force on the plug when expanding at a point distal from the slider.

* * * * *